US005557070A

United States Patent [19]

Tamm

[11] Patent Number: 5,557,070

[45] Date of Patent: Sep. 17, 1996

[54] ERGONOMIC TWIST-ON WIRE CONNECTOR CAP

[75] Inventor: Carl R. Tamm, Jonesborough, Tenn.

[73] Assignee: Buchanan Construction Products, Inc., Hacksettstown, N.J.

[21] Appl. No.: 371,397

[22] Filed: Jan. 11, 1995

[51] Int. Cl.[6] ..... H01R 4/22

[52] U.S. Cl. ..... 174/87; 174/84 R; 174/84 C; 174/74 A

[58] Field of Search ..... 174/87, 84 R, 174/84 C, 74 R, 74 A

[56] References Cited

U.S. PATENT DOCUMENTS

| | | | |
|---|---|---|---|
| D. 186,599 | 11/1959 | Schinske | D26/10 X |
| 5,023,401 | 6/1991 | Clifton | 174/87 |
| 5,132,494 | 7/1992 | Burton et al. | 174/87 |
| 5,256,962 | 10/1993 | Munniksma et al. | 324/133 X |
| 5,260,515 | 11/1993 | Braun, Jr. | 174/87 |

*Primary Examiner*—Kristine L. Kincaid
*Assistant Examiner*—Chau N. Nguyen
*Attorney, Agent, or Firm*—Dorn, McEachran, Jambor & Keating

[57] ABSTRACT

A cap for a twist-on electrical connector includes a body formed of a semi-rigid insulating material and having a central bore, open at one end and closed at the other end by an integral end wall. The bore of the cap is formed to receive a wire clamping structure such as a coiled spring. The body has a first exterior portion of maximum diameter generally adjacent the open end. Substantially the remaining portion of the body is generally conical and has a pair of generally oppositely positioned laterally extending wings. The wings are each generally tangential to the conical body portion and the outwardly facing side of each wing has a concave pressure application surface area.

12 Claims, 2 Drawing Sheets

Fig.1.
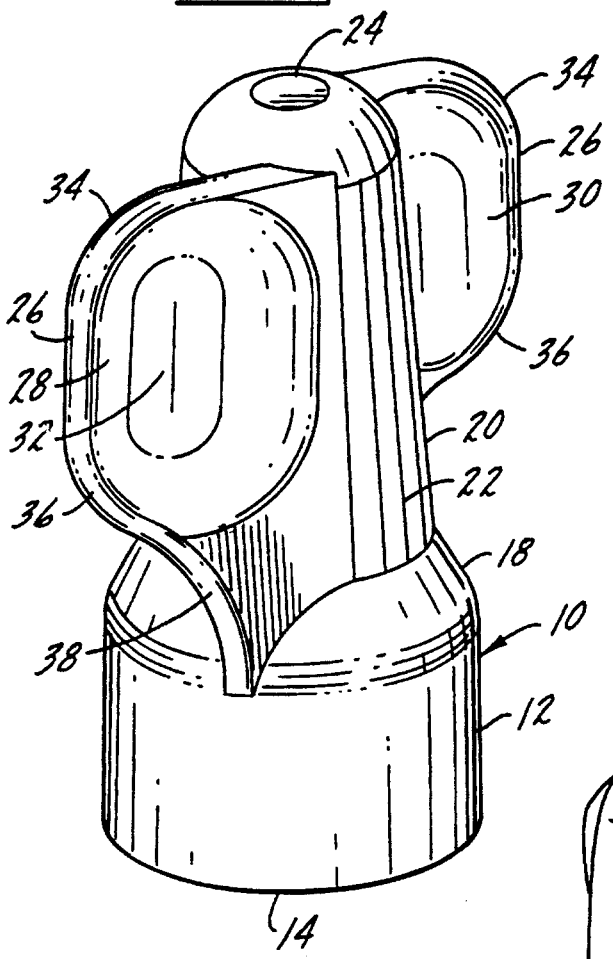
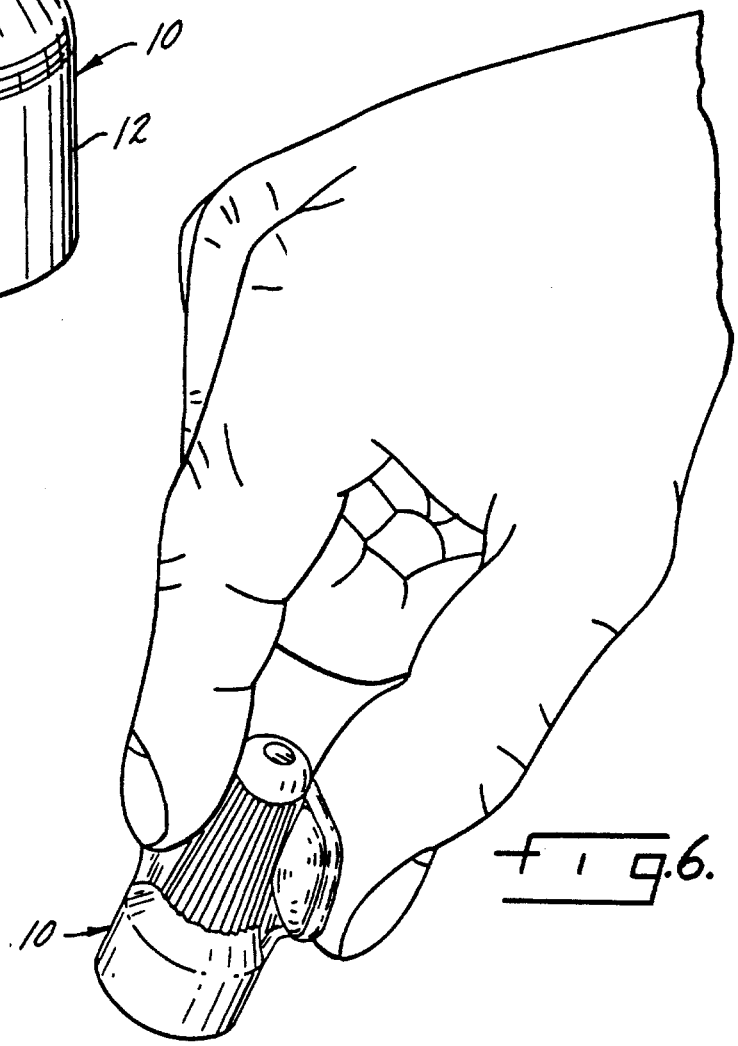
Fig.6.

Fig. 2.
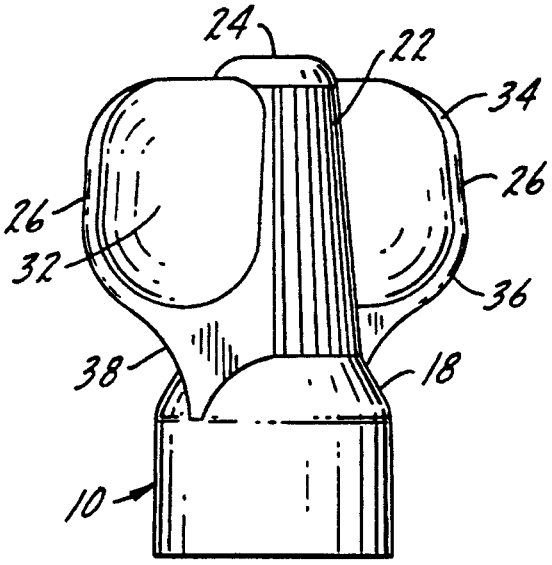
Fig. 3.
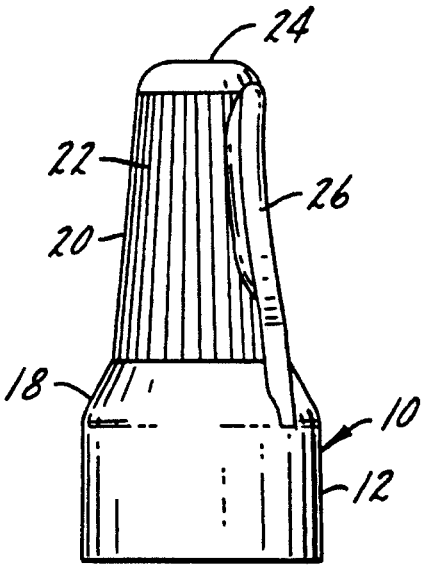
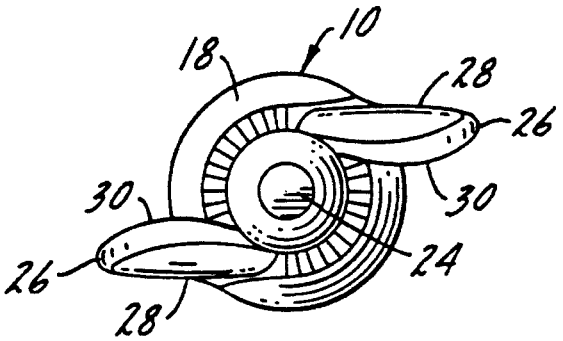
Fig. 4.
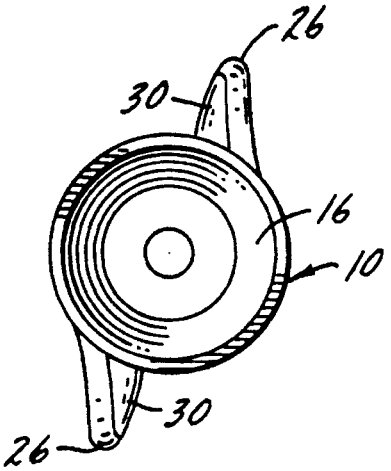
Fig. 5.

ERGONOMIC TWIST-ON WIRE CONNECTOR CAP

THE FIELD OF THE INVENTION

The present invention relates to twist-on wire connectors used primarily for connecting a plurality of electrical conductors. More particularly, the invention relates to the insulating cap which forms the outer shell for the connector providing not only the electrical insulation required for the connection, but also the external periphery of the shell which affords the user with the means to install the connector, applying both forward thrust and substantial torque with the fingers of the electrician's hand. The present insulating cap is unique in that it provides an ergonomically correct design which will protect the installer from traumatization of tissue and undue stress on the musculo-skeletal structure of the human hand.

U.S. Pat. Nos. 4,220,811, 4,227,040, 4,691,079, Des. 315,139 and Des. 315,143, all owned by Ideal Industries, Inc., of Sycamore, Ill., show generally the type of electrical twist-on connector which is the subject of the present invention.

SUMMARY OF THE INVENTION

The present invention relates to twist-on electrical wire connectors and particularly to a wire connector cap which reduces the traumatization of tissue and stress on those portions of the hand which apply the connector.

One purpose of the invention is to provide a cap for a twist-on electrical connector which is contoured to provide maximum surface area for the applying finger, thus minimizing tissue compression.

Another purpose is a connector of the type described using a plurality of laterally extending wings which are so located as to keep the applying fingers away from the open end of the connector to avoid any contact with the wire conductors positioned therein.

Another purpose is a twist-on wire connector of the type described in which the wings or pressure application surfaces are as small as practical so as not to interfere with the available space within an electrical junction box.

Another purpose of the invention is to provide a twist-on electrical wire connector as described in which the connector body has laterally extending wings, generally tangential to the general conical exterior of the body, with the wings each having an outwardly facing generally concave pressure application surface.

Another purpose is to provide a wire connector as described in which the torque applying areas do not visually obstruct nor encourage finger positions which visually obstruct the open end of the connector where the wires are inserted.

Other purposes will appear in the ensuing specification, drawings and claims.

BRIEF DESCRIPTION OF THE DRAWINGS

The invention is illustrated diagrammatically in the following drawings wherein:

FIG. 1 is an enlarged perspective of the connector of the present invention;

FIG. 2 is a front view of the connector of FIG. 1;

FIG. 3 is a side view of the connector of FIG. 1;

FIG. 4 is a top view of the connector of FIG. 1;

FIG. 5 is a bottom view of the connector of FIG. 1; and

FIG. 6 is a diagrammatic illustration of the manner of application of the connector of the present invention.

DESCRIPTION OF THE PREFERRED EMBODIMENT

It is common in the electrical wiring industry, in residential, commercial and industrial applications, to use twist-on wire connectors as the primary means of securing a plurality of electrical conductors to provide a secure electrical connection and one which is safely insulated at its periphery. Typical connectors of such design comprise a tapered coil spring housed within a thermoplastic shell. When the connector is rotated, the coil spring engages the electrical conductors threading the connector onto the conductor bundle, thus twisting and pressing the conductors against one another. The coil spring surrounds the stripped ends of the conductors entirely, gripping them tightly together, with the resilient memory of the spring maintaining pressure on the enclosed conductor ends. The thermoplastic shell of such connectors is typically formed in a conical or frustum shape having one end closed, with the opposed end open to receive the conductors. The cone-shaped shell thus formed provides an insulating means for the completed connection, as well as providing internal engagement with the spring to provide the means by which torque is transmitted to the spring from the driving force on the connector which is typically a human hand.

Characteristic of most such connector caps is a variety of either radially arranged ribs, opposed fins or wing-like projections, or a combination of the same, all positioned at various locations on the external periphery of the cap. Such application structure is provided to improve the grip of the cap with human fingers. The radially arranged ribs are typically a low profile feature and serve primarily to provide a secure exterior gripping surface. The torque applied by such a device is limited to the maximum diameter and the installer's ability to grip the exterior surface. Typically, such designs are used primarily for stranded wire or to join only two or three conductors in a single connection because of the limited torque capability.

With the more common connections made during building construction where the installer is faced with many different combinations of both solid and stranded conductors, and substantial torque must be provided to connect the combinations of conductors, it is desirable that a pair of opposed projections or wings be provided to amplify the torque applied by the electrician's fingers. Since a considerable number of such connections may occupy a typical junction box, it is necessary that the connector be as small as practically possible, but yet provide ample size for gripping, twisting, and the application of sufficient torque to make the connection. Opposed fins or low profile projections which extend axially along the periphery of the cap meet the space requirements, but often do not have sufficient extension for the user to apply sufficient torque. Wing-like projections which extend further may provide the torque, but take up substantial space within the junction box.

In the past it has been customary to provide winged connectors for their improved torque amplification. The wings are generally located adjacent the open end of the connector, typically on the flared-out skirt which constitutes the portion of greatest diameter of the cap. This construction is done primarily for the convenience and economics of manufacturing. This design allows for simple manufacture of the mold, as well as simple ejection of the molded part from the mold cavity. Consideration for human engineering has been virtually non-existent in the design of such wire connectors.

Increasing awareness of cumulative trauma disorders such as carpal tunnel syndrome, tenosynovitis, ischemia, and even tennis elbow, and their relation to jobs requiring repetitive hand motion such as twisting on wire connectors, has become a primary factor in the design of items which are applied with or used in the human hand. Proper design of such devices requires the application of technical, anatomic, anthropometric and kinesiological considerations. Such is the focus of the present invention.

To provide an ergonomically correct design in a wire connector, evaluation of application forces required including their direction and amplitude must be understood. Also, one must determine and evaluate the force available from a typical human hand and the optimum directions in which this force may be imparted.

Underwriters Laboratories Standard 486C, which is also recognized as ANSI Standard 486C provides the industry standard for hand or tool applied pressure on wire and cable connectors intended for use with copper, aluminum, or copper-clad aluminum insulated conductors in accordance with the National Electrical Code. These requirements apply to twist on wire connectors, and are the criteria to which all twist on wire connectors are designed and manufactured in the U.S.

The application forces for twist on wire connectors are specified in paragraph 7.22 as being the lesser of:

(A) One-half pound-inch (0.056 Nm) per 1000 circular mil (0.111 $Nm/mm^2$) area for the total circular mil ($mm^2$) area of copper conductors in the combination under test plus 0.3 pound-inch per 1000 circular mil (0.066 $Nm/mm^2$) area for the total circular mil ($mm^2$) area of aluminum conductors in the combination under test; or (B) Twelve and one-half pound-inch per inch (0.0555 Nm/mm) of gripping diameter.

From this information one can calculate that a typical winged connector of a 1.0" maximum gripping diameter, and a maximum fill combination of five #12 AWG copper conductors would be subjected to 16.33 lbf/in per the conductor combination, but the lesser value of 12.5 lbf/in. calculated from the maximum connector diameter will apply. Typical studies of field installations reveal that the torque levels actually applied will vary between the UL 486C requirements to approximately 30% above those requirements. Thus, it can be determined that typical mid-size twist on wire connectors, which will make up about 80% of the electrical construction and maintenance market, will be applied using torque levels between 12.5 and 16.25 lbf/in. (1.412 and 1.836 Nm) for the largest conductor combinations.

Physical forces which may be imparted from a typical human hand are a bit more difficult to measure and identify. The optimum position of the fingers when grasping a twist on wire connector is a combination of or variance between two of the recognized basic grips, the "tip" or (pinch) grip, and the "lateral" or (key) grip which is typical of the opposed thumb pressing in a lateral fashion against the side of the second phalanx of the index finger. When the fingers are thus positioned, with the end of the index finger directly opposed to the end of the thumb and radially displaced approximately three-quarters of an inch, the index finger is within the optimum force direction of 45 to 65 degrees from the plane of the palm (Ref. Humanscale, by Henry Dreyfuss Assoc., Massachusetts Institute of Technology,) and the thumb is directing force exactly perpendicular to the plane formed by the thumb joints and toward the center of the palm. This position allows the finger and thumb to provide maximum effort while subjecting the muscles, tendons, and joints to minimal stress.

Due to the inadequate design of present wire connectors in regard to human factors, it is common to observe persons applying the connectors with hand and finger positions much opposed to the optimal position described above. Pain generated due to excessive tissue compression resulting from the inadequate design of connectors presently on the market causes installers to seek a position in the fingers, away from the more sensitive finger tips which have extensive nerve endings. When these connectors are used, it is common to see installers gripping the connector between the second phalanx of the index finger and the interphalangeal joint of the thumb. This can be easily evidenced by observing calluses in these areas of the fingers of electricians who manually install many of these twist on connectors on a daily basis.

The forces applied in this manner subject the interphalangeal joints of the index finger as well as the thumb to lateral stress. These joints, being "hinge joints," provide motion on only one plane, and forces in lateral directions to this plane subject these joints to excessive stress.

The inappropriate design of present connectors also subjects the installers fingers to excessive tissue compression, manifested by superficial lesions, such as blisters and calluses. This discomfort is addressed to a degree in U.S. Pat. No. 4,924,035 with reference to a "two point threshold of discrimination for a human finger", further described as "the distance on the skin of a person where pressure that is applied at one point or two points cannot be differentiated and seems as if at one point." This is further specified as: "generally in the order of three to six millimeters." This patent and related art are directed to the semi-conical wire connector having a plurality of grooves or equally spaced low profile ribs about the entire external periphery of the cap. In this application, the ribs or serrations are included to improve the traction between the fingers and the surface of the cap.

In the case of finned or winged twist on wire connectors, those having projections, typically two, extending radially outward in directions primarily opposite one another, for the purpose of maximizing the moment arm about the axis of the cap thereby amplifying the torque applied by the fingers, the surface area requirements are often neglected. Many connectors presently on the market provide wings which are coplanar, extending perpendicular to the axis of the cap. This affords a large gap between the radial surface of the cap and the end of the wing or fin when grasped by the fingers, thereby concentrating the pressure of compression on the small areas of tissue which actually contact the edge of these wings. The preferred design for such contact surfaces, which is provided by the present invention, is tangential to the radial surface of the cap, leaving no space for unsupported tissue.

The surface area provided by the wing is important. Excessive tissue compression, manifested by superficial lesions such as blisters and calluses, is the direct result of inadequate surface area to absorb the directional forces of installation. The surface area of each wing in the direction of applied force provided by this invention is (0.225 $in^2$,) three times that of the average comparable areas of all the major brands on the market today, (0.075 $in^2$.). Of these major brands, the largest comparable surface area per wing is 0.132 $in^2$, and the smallest is 0.049 $in^2$, with all others falling below 0.080 $in^2$. Furthermore, this area must be contoured to accept the spheroidal ends of the index finger and thumb. U.S. Pat. No. Des. 315,143 illustrates a slightly contoured shape from the end view; however, the side views and the actual product exhibit this contour to be only unidirectional.

The incorporation of spheroidal dimples of the present invention provides a pronounced and ever increasing area of angular finger contact, which further improves the already angular displaced wings, providing a sufficient area equivalent to approximately 22.5° per wing or 50° inclusive between the two wings from axial alignment. This provides substantially more resistance to forward movement of the fingers on the wings than does the singular planar axial displacement of the wings as illustrated by the '143 patent.

An additional issue regarding all wing style twist on wire connectors is the location of the wings. Designed for economical molding of the thermoplastic shell, the wings, being the largest diametral feature of the cap are located on the open end which is the end ejected from the mold. The ergonomic significance of this configuration is that the fingers obstruct the line of sight to the end of the cap where the installer must introduce the cut and exposed ends of the conductors. Due to the installers inability to see the end of the cap, it is necessary to either reposition the wires and connector temporarily, typically by combination of ulnar deviation and palmer flexion, or adjust the body accordingly to allow visual aid when inserting the conductors initially. The twisting motion required to complete the connection commonly incorporates supination, rotating the forearm clockwise, as the torque required in the majority of these connections cannot readily be attained by simple finger action. The combined effort of maintaining the connector in axial alignment with the conductors and the action of supination is not possible with the wrist in palmer flexion, and it is necessary that the connector and wires, or the body, be repositioned from the visual position needed to introduce the conductors into the connector, particularly in overhead installations such as lighting circuits. One can readily see that this factor requires much excess motion in the process of installing a twist on wire connector of the prevalent designs common in manufacture today.

The twist-on wire connector of the present invention includes a body 10 having a first exterior portion 12 which is generally cylindrical in configuration and provides the maximum diameter of the connector body. This portion of the connector is adjacent the open end 14 of the connector body. As particularly illustrated in FIG. 5, the connector body is hollow or has an interior chamber 16, with the chamber 16 generally being formed and adapted to hold a clamping device, typically a coiled wire spring. Such is not shown in the present application, although clearly wire connectors having internal coiled springs are well known in the art, witness the above-described patents of Ideal Industries. Preferably, the connector body will be formed of a thermoplastic or some rigid insulating material.

Directly adjacent the cylindrical portion 10 of the connector body is a tapered or conical portion 18 which is of relatively short axial length and then a further tapered portion 20 having ribs or the like 22 formed on the exterior thereof. The tapered portion 20 extends generally a substantial distance of the overall axial length of the connector. The cylindrical portion 12 may be approximately one-third of the length, and the wings to be described will have a concave pressure application surface which is generally half of the total axial length of the connector. The end of the connector is closed by an integral end wall 24, as illustrated particularly in FIGS. 1, 2 and 3.

There are a pair of generally oppositely directed wings 26 extending from the conical portion 20 and in part from the tapered area 18 of the connector exterior. The wings 26, as particularly shown in FIG. 4, are generally tangentially connected to the connector body. The points of tangency are generally diametrically opposed so that the wings each extend laterally outwardly from the connector at locations approximately 180° apart. Because each of the wings 26 extend tangentially or laterally from the connector or cap body, each has an outer pressure application face 28 and an inner face 30. Each of the outer faces 28 is concave in the area of pressure application, as indicated at 32. This concavity is both lateral and axial. In effect, the concave area or pressure application area 32 can be considered to be a portion of a sphere or spheroidal in configuration. In like manner, the inwardly directed faces 30 will be somewhat convex, as although they are not formed identically with the outer surfaces, they are similar and so if the outer surface is concave, the inner surface will be convex. In some applications the outer surface 30 may only be partially convex and in other applications, primarily due to manufacturing considerations, it may be generally planar.

Each of the wings 26 has curved corners, as indicated at 34 and 36, these areas being curved so as to reduce the possibility of trauma to the fingers applying the connector to the wires. Similarly, there is a fillet 38 which joins the lower portions of the wings to the tapered area 18 on the connector exterior.

The pressure application surfaces 30 preferably extend a distance approximately one-half of the axial length of the connectors. This provides an ample area for pressure application, while not making the wings so large as to hinder the use of connectors of this type within the confines of a junction box.

The pressure application surfaces 30, which are on the outside of the connector, as is obvious from the drawings, will result in a clockwise application of torque to the connector when it is applied to the wire bundle position within the open interior of the connector.

Of importance in the invention is the concave or spheroidal pressure application surfaces which reduce the stress and trauma of the fingers applying the connector. Also important is the fact that the wings are not at the open end of the connector, but are spaced therefrom so as to provide an unobstructed view for the electrician of the wires to which the connector is being applied. Further, the wings extend outwardly beyond the body of the connector to increase the lateral extent of the pressure application areas.

Whereas the preferred form of the invention has been shown and described herein, it should be realized that there may be many modifications, substitutions and alterations thereto.

The embodiments of the invention in which an exclusive property or privilege is claimed are defined as follows:

1. A cap for a twist-on electrical connector includes a body formed of a semi-rigid insulating material and having a central bore, open at one end and closed at the other end by an integral end wall, said bore being formed and adapted to contain a wire conductor clamping means therein, said body having a first exterior portion of maximum diameter generally adjacent the open end, substantially the remaining portion of said body having a generally conical exterior surface, said generally conical exterior surface having a pair of generally oppositely positioned laterally extending wings, the wings each being generally tangential to the conical body portion exterior surface, each wing having an inwardly facing side surface and an outwardly facing side surface, the outwardly facing side surface of each wing having a concave pressure application surface area.

2. The cap of claim 1 characterized in that said pressure application surface area is concave in both the lateral and axial directions.

3. The cap of claim 2 characterized in that said concave surface area extends over a substantial portion of each wing.

4. The cap of claim 1 characterized in that the concave pressure application surface area on each wing extends over a portion of the wing adjacent the closed end of the cap.

5. The cap of claim 1 characterized in that each wing extends axially generally a distance from the first portion of maximum diameter to the integral end wall.

6. The cap of claim 1 characterized in that each wing extends radially beyond the first portion of maximum diameter.

7. The cap of claim 1 characterized in that each wing has curved outer corners.

8. The cap of claim 1 characterized in that said first exterior portion of maximum diameter is generally cylindrical.

9. The cap of claim 8 characterized in that said cap has an axial length, with said first exterior portion extending generally one-third of said axial length.

10. The cap of claim 1 characterized in that said cap having an axial length, with the concave pressure application surface area of each wing extending generally one-half of the axial length of the cap.

11. The cap of claim 1 characterized in that each concave pressure application surface area is generally spheroidal in configuration.

12. The cap of claim 1 characterized in that the inwardly facing side of each wing is generally convex in an area opposite the concave pressure application surface area.

* * * * *